US006361623B1

(12) United States Patent
Ishikura et al.

(10) Patent No.: US 6,361,623 B1
(45) Date of Patent: Mar. 26, 2002

(54) METHOD FOR PHOSPHATIZING IRON AND STEEL

(75) Inventors: Kazuhiro Ishikura; Manabu Kumagaya, both of Kanagawa-ken; Takaomi Nakayama, Hiratsuka, all of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/445,799

(22) PCT Filed: Jun. 12, 1998

(86) PCT No.: PCT/US98/11404

§ 371 Date: Dec. 13, 1999

§ 102(e) Date: Dec. 13, 1999

(87) PCT Pub. No.: WO98/56962

PCT Pub. Date: Dec. 17, 1998

(30) Foreign Application Priority Data

Jun. 13, 1997 (JP) ..... 9-173170

(51) Int. Cl.[7] ..... C23C 22/78
(52) U.S. Cl. ..... 148/254; 148/259; 148/260
(58) Field of Search ..... 148/254, 263, 148/250, 253, 259

(56) References Cited

U.S. PATENT DOCUMENTS

| | | | | |
|---|---|---|---|---|
| 2,310,239 A | | 2/1943 | Jernstedt | |
| 2,322,349 A | | 6/1943 | Jernstedt | |
| 2,874,081 A | | 2/1959 | Cavanaugh et al. | |
| 3,395,052 A | * | 7/1968 | Yonezaki et al. | 148/254 |
| 4,517,029 A | | 5/1985 | Sonoda et al. | |
| 5,221,370 A | * | 6/1993 | Jo et al. | 148/250 |
| 5,326,408 A | * | 7/1994 | Cormier | 148/254 |

FOREIGN PATENT DOCUMENTS

| | | |
|---|---|---|
| JP | 60 20463 | 5/1985 |
| JP | 10-46351 | 2/1998 |

* cited by examiner

*Primary Examiner*—John Sheehan
*Assistant Examiner*—Andrew L. Oltmans
(74) *Attorney, Agent, or Firm*—Stephen D. Harper; Michael S. Brodbine

(57) ABSTRACT

A high quality lubricant carrier for lubrication in cold plastic working of iron and steel is provided by a process in which the surfaces of objects to be worked are first treated with a surface conditioning liquid composition that contains dispersed fine particles of at least one of a Jernstedt salt, zinc phosphate, zinc calcium phosphate, and calcium phosphate, and is then treated by a phosphatizing solution that contains calcium cations.

8 Claims, No Drawings

METHOD FOR PHOSPHATIZING IRON AND STEEL

FIELD OF THE INVENTION

This invention pertains to a method of phosphatization that is primarily employed as a lubricating pretreatment for cold plastic working of iron and steel.

RELATED ART

In general, iron and steel are made into steel tubing, wire rods, and forged articles of manufacture from a raw material called a billet by hot processing and are then processed into a specified final shape and form by means of cold plastic working, such as wire drawing, tube reducing, forging, and cold pressing.

However, there is great mechanical resistance to shaping during cold plastic working of most commercial alloys of iron and steel, making the process difficult; therefore, the work pieces are usually first lubricated prior to processing. The lubricating method most often employed is to form a film such as a phosphate film on the surface of the material, then to coat this film with lubricating oil or a solid lubricant.

In the lubricating process, the formed film is used as the base for lubrication. For example, in wire drawing, the lubricant is drawn into the die, preventing the metals of the tool and the metal material from coming into contact with each other during the process (cf. *Manual of Lubricants for Wire Drawing of Iron and Steel*, edited by the Plastic Working Institute, Wire Drawing Technology Division, Subcommittee on Lubricants, 1994).

Dissolution of the metal is the driving force of film formation. For example, a treatment solution whose primary components are zinc ions and phosphate ions is used in the phosphatization treatment called the zinc phosphating system, and minute anode portions on the surface of the iron and steel are corroded by the etching effect of the phosphoric acid. The hydrogen ions in the treatment solution are reduced at minute cathode portions to form hydrogen gas; it is believed that this reaction increases the pH value of a thin zone adjacent to the interface between the treatment solution and the surface of the iron and steel, forming a phosphate film that is not highly soluble. Because the film is formed utilizing a dissolution reaction, the film adhesion is excellent, favoring superior coating adhesion and cold workability.

There are several types of such phosphate film, but those most widely used as the base for lubrication of iron and steel are zinc phosphate films with the approximate chemical formula $Zn_3(PO_4)_2.4H_2O$), zinc ferrous phosphate film with the approximate chemical formula $Zn_2Fe(PO_4)_2.4H_2O$, and zinc calcium phosphate film with the approximate chemical formula ($Zn_2Ca(PO_4)_2.2H_2O$) (cf. *Manual of Lubricants for Wire Drawing of Iron and Steel*, edited by the Plastic Working Institute, Wire Drawing Technology Division, Subcommittee on Lubricants, 1994, p. 24). Phosphate crystals with one of the above approximate chemical formulas rarely are the sole constituent of a phosphate film; instead these crystals coexist in a mixture in phosphate films formed under the usual conditions.

For example, zinc phosphate and zinc ferrous phosphate are obtained by treatment of a ferriferous substrate with a solution whose primary constituents are zinc ions and phosphate ions, but these crystal constituents are usually eutectic, and rarely crystallize alone. Similarly, zinc calcium phosphate is obtained by treatment with a solution whose primary constituents are zinc ions, calcium ions, and phosphate ions, but is eutectic with zinc phosphate and zinc ferrous phosphate.

Thus, phosphatization can be roughly divided into two types: (1) zinc-type phosphatization, in which the materials are treated with a solution whose primary constituents are zinc ions and phosphate ions; and (2) calcium-type phosphatization, in which the materials are treated with a solution whose primary constituents are zinc ions, calcium ions, and phosphate ions.

Zinc-type phosphatization and calcium-type phosphatization are used as the base for lubrication of iron and steel, the type to be used being determined by the purpose. Zinc-type phosphatization is suited for overall cold plastic working, and various lubricants are used after phosphatization. In particular, lubrication treatment in conjunction with a reactive soap lubricant imparts superior lubricity, and therefore is used in the most demanding processes, such as cold forging and cold pressing (cf. *Manual of Lubricants for Wire Drawing of Iron and Steel*, edited by the Plastic Working Institute, Wire Drawing Technology Division, Subcommittee on Lubricants, 1994, p. 26).

Meanwhile, although the quantity of the film is smaller in calcium-type phosphatization, the obtained crystals are fine and are highly workable, and therefore this type of phosphatization is used to prevent die clogging, which is a critical problem in forging and cold pressing. There are cases in which the excess phosphate film falls off during cold forging or cold pressing and adheres to the work piece, resulting in a fatal product defect—the inability to achieve the specified degree of precision with respect to dimensions.

Treatment with a reactive soap lubricant is achieved by immersing the phosphatized material in an aqueous solution of sodium or potassium soap (salts of fatty acids) heated to 60 to 95° C. The reaction mechanism is that the phosphate film dissolves in the aqueous solution of soap, followed by the replacement reaction with at least some of the constituent cations comprising the phosphate crystals to produce a metallic soap that is much less soluble in water than the sodium or potassium soap dissolved in the aqueous treatment solution, and the precipitation of this less soluble metallic soap onto the phosphate film.

For example, the reaction between zinc phosphate tetrahydrate ($Zn_3(PO_4)_2.4H_2O$) and sodium stearate ($C_{17}H_{35}COONa$) produces zinc stearate, as shown in the following equation:

$$Zn_3(PO_4).4H_2O+6C_{17}H_{35}COONa \rightarrow 3(C_{17}H_{35}COO)_2Zn+2Na_3PO_4+4H_2O.$$

However, for reaction with aqueous solutions of soluble soaps, zinc phosphate has the fastest reaction rate, followed by zinc ferrous phosphate and zinc calcium phosphate in that order. Because zinc calcium phosphate has a particularly slow reaction rate, lubrication rarely involves combination with a reactive soap lubricant when the primary constituent of the phosphate film is zinc calcium phosphate.

Japanese Laid-Open Patent Application Sho[wa] 60-20463 discloses a cold processing lubrication method for iron and steel in which the surface of the iron and steel is first treated with a phosphate-forming treatment solution that contains calcium ions, zinc ions, phosphate ions, and nitrate ions, in which the weight ratio of the calcium ions to the zinc ions is 0.1 to 1.0, and the weight ratio of the nitrate ions to the phosphate ions is 1.0 to 5.0, and the pretreated material is then treated with a lubricant. This teaching is a treatment method that is ideal when using a reactive soap lubricant after calcium type phosphatization, and its primary purpose is to ensure that there are appropriate quantities of zinc calcium phosphate and zinc phosphate in the film by ensuring an appropriate weight ratio of calcium ions to zinc ions in the phosphatizing solution.

In addition, Japanese Laid-Open Patent Application Hei [sei] 8-215287 discloses a method of phosphatizing high carbon, chrome bearing steel wire in which the surface of the steel wire is treated with a phosphauizing solution that contains calcium ions, zinc ions, phosphate ions, and nitrate ions, in which the weight ratio of the calcium ions to the zinc ions is 0.5 to 1.5. This teaching pertains to a surface treatment method in which the high carbon, chrome bearing steel wire is treated with a lubricant whose primary constituents are calcium hydroxide, also called lime soap, and calcium soap, after undergoing calcium type phosphatization, with a primary purpose of ensuring the formation of a zinc calcium phosphate film that is protective against die clogging by ensuring an appropriate weight ratio of calcium ions to zinc ions in the phosphatizing solution.

However, when employing the methods described in the aforementioned Japanese Laid-Open Patent Application Sho [wa] 60-20463 and Japanese Laid-Open Patent Application Hei[sei] 8-215287, it was necessary to adjust the ratio of the calcium ions to the zinc ions in the phosphatizing solution within the specified range in order to obtain a phosphate film with the most preferred composition. In actual commercial operations, substrates with more than one processing purpose are treated in succession. Therefore, the ratio of calcium ions to zinc ions in the phosphatizing solution needs to be adjusted, or multiple phosphatization vessels need to be installed, in order to obtain a phosphate film with the preferred composition when employing the aforementioned methods in practical use on substrates for more than one processing purpose.

Furthermore, in order to adjust the phosphatzing solution, it is necessary to remove part of the solution from the phosphatization vat and add an additive that contains zinc ions or calcium ions; this makes the work rather complicated. When multiple vats are installed, each vat must always be maintained at a fixed concentration and temperature; thus, this method is disadvantageous in terms of work space and energy cost.

As described above, there were problems associated with conventional methods: The work space became rather large, the energy cost increased, and the operational properties were compromised.

PROBLEM(S) TO BE SOLVED BY THE INVENTION

The aim of this invention is to overcome at least one of the above mentioned problems associated with the prior art, and to provide a method of phosphatizing iron and steel by forming a phosphate film with the target composition on the surface of the iron and steel, thus resolving the problems of poor lubrication and die clogging.

SUMMARY OF THE INVENTION

It has been discovered that these problems could be resolved by treating iron and steel with a calcium phosphate-type phosphatizing solution after pre-treating the surface of the iron and steel with a surface conditioning solution with a specific composition, thereby perfecting this invention. In other words, this invention provides a method of phosphatizing iron and steel that, in one embodiment, is characterized by the fact that the surface of the iron and steel is first treated with a surface conditioning liquid composition that contains as its essential ingredient dispersed fine particles of at least one of the following water-insoluble compounds: zinc phosphate, zinc calcium phosphate, and calcium phosphate, and is then treated with a phosphatizing solution that contains calcium ions as its essential ingredient. In another embodiment, this invention provides a method of phosphatizing iron and steel that is characterized by the fact that the surface of the iron and steel is first treated with a surface conditioning liquid composition that contains colloidal titanium as its essential ingredient, and is then treated with a phosphatizing solution that contains calcium ions as its essential ingredient.

DETAILED DESCRIPTION OF THE INVENTION

The types of iron and steel that can be treated by this invention are not narrowly restricted; some examples would be carbon steel, chrome steel, chrome-molybdenum steel, nickel-chrome steel, nickel-chrome-molybdenum steel, boron steel, and manganese steel.

In one embodiment of this invention, the surface of the iron and steel is first treated with a surface conditioning liquid composition that contains as its essential ingredient dispersed fine particles of at least one of the following water-insoluble compounds: zinc phosphate, zinc calcium phosphate, and calcium phosphate. In concrete terms, any of the following compounds can be used as the water-insoluble phosphate that is to be the essential ingredient of the surface conditioning solution to be used in this invention: $Zn_3(PO_4)_2$, $Zn_2Ca(PO_4)_2$, $CaHPO_4$, $Ca_3(PO_4)_2$, and $Ca(H_2PO_2$.

In addition, the surface conditioning liquid composition may contain other water-insoluble phosphates, such as the following, as optional ingredients: $Zn_2Fe(PO_4)_2$, $Zn_2Mn(PO_4)_2$, $Zn_2Ni(PO_4)_2$, $FePO_4$, $Mn_3(PO_4)_2$, $Mn_2Fe(PO_4)_2$, $Ni_3(PO_4)_2$, $CoPO_4$, $Ca_3(PO_4)_2$, and $AlPO_4$.

Furthermore, hydrates of the above mentioned substances, as well as substances of indefinite crystal form and non-crystalline substances, may also be used.

In the method of phosphatizing iron and steel of this invention, it is necessary that the water-insoluble phosphate in the aforementioned surface conditioning liquid composition contain as its essential ingredient at least one of the following: zinc phosphate, zinc calcium phosphate, and calcium phosphate. If the surface of the iron and steel is treated with a surface conditioning liquid composition that has zinc phosphate as its only essential ingredient, a phosphate film that has zinc phosphate and zinc ferrous phosphate as its principal ingredients will be formed. If the surface conditioning liquid composition has zinc calcium phosphate as its only essential ingredient, a phosphate film that has zinc phosphate and zinc calcium phosphate as its principal ingredients will be formed, while if the surface conditioning liquid composition has calcium phosphate as its only essential ingredient, a phosphate film that has zinc calcium phosphate as its principal ingredient will be formed.

It is perfectly acceptable according to this invention to use a mixture of zinc phosphate, zinc calcium phosphate, and calcium phosphate in the surface conditioning liquid composition; in such a case, the composition of the phosphate film can be controlled even more precisely. In concrete terms, desirable water-insoluble phosphates include $Zn_3(PO_4)_2$, $Zn_2Ca(PO_4)_2$, $CaHPO_4$, $Ca_3(PO_4)_2$, and $Ca(H_2PO_4)_2$. Furthermore, hydrates of the above mentioned substances as well as substances of indefinite crystalline form and non-crystalline substances may also be used.

Alternatively, in this invention, the surface of the iron and steel may also be treated with a phosphatizing solution that has calcium ions as its essential ingredient after pre-treatment with a surface conditioning liquid composition that contains colloidal titanium.

Ideally, the colloidal titanium used in this step is a "Jernstedt salt" that has titanium, anions derivable by ionization of pyrophosphoric acid, ions derivable by ionization of orthophosphoric acid, and sodium ions as its constituents, as is disclosed in one or more of U.S. Pat. No. 2,874,081, U.S. Pat. No. 2,322,349, and U.S. Pat. No. 2,310,239.

A phosphate film that has zinc phosphate as its principal ingredient will be formed if the surface of the iron and steel is treated with a calcium-type zinc phosphatizing solution after pre-treatment with a surface conditioning liquid composition that contains colloidal titanium.

The water-insoluble phosphates and colloidal titanium in the surface conditioning liquid composition used in this invention are preferably used in a suspension with water as the dispersion medium at a concentration of 0.01 to 50 grams per liter, hereinafter usually abbreviated as "g/L", and more preferably 0.1 to 10 g/L, at a treatment temperature of 20 to 85° C. When the concentration falls below 0.01 g/L, it is difficult to achieve the surface conditioning effect; when it exceeds 50 g/L, no additional conditioning effect is achieved, and this is uneconomical.

Commercially available ingredients and reagents can be used as the water-insoluble phosphates that are contained in the surface conditioning liquid composition. Compounds synthesized from water-soluble salts of zinc and/or calcium and water-soluble phosphates are suitable for use as well.

With respect to colloidal titanium-containing surface conditioning liquid compositions, those that are sold as surface conditioners, e.g., PREPALENE® Z manufactured by Nihon Parkerizing Co., Ltd., can be used.

With respect to the particle size of the insoluble phosphate and/or colloidal titanium in the surface conditioning liquid composition to be used in this invention, the smaller the particle size, the higher the efficacy; a lower concentration of small particle size can achieve the same efficacy as a solution with a higher concentration of large particle size. A mechanical crushing device such as a ball mill can be employed in order to reduce the particle size.

Minute particles of metallic oxides may also advantageously be added to the surface conditioning liquid composition to be used in this invention. Aggregation of the primary particles of the phosphate and/or colloidal titanium in the surface conditioning liquid composition can be prevented by adding such minute metal oxide particles. Metallic oxides selected from silicon, boron, titanium, zirconium, aluminum, lead, magnesium, cerium, zinc, tin, iron, molybdenum, and vanadium are suitable for use in this manner. With respect to the quantity to be added, 0.001 to 5 g/L is effective.

Furthermore, alkali metal salts and/or ammonium salts, in both instances including acid salts as well as fully neutralized salts, of orthophosphoric acid, metaphosphoric acid, pyrophosphoric acid, orthosilicic acid, metasilicic acid, carbonic acid, and boric acid can be added to the surface conditioning liquid composition. Anionic water-soluble polymers, nonionic water-soluble polymers, anionic surfactants, nonionic surfactants, etc., can be added as well. These compounds can prevent the aggregation of the phosphate and/or colloidal titanium in the surface conditioning Jiquid composition and thereby improve the stability of the dispersion.

When one uses this invention, several types of surface conditioning liquid compositions can be prepared in advance and stored in a storage tank, and placed in a pre-installed surface conditioning liquid composition vat immediately prior to phosphatization as needed in order to alter the composition of the phosphate film. In the application of this invention, the surface conditioning can be accomplished by spraying as well as by the more commonly used immersion; the effect achieved will be the same.

Commercially available preparations that contain zinc ions, calcium ions, and anions derivable by the ionization of phosphoric acid can be used as the phosphatizing solution; furthermore, nitrates, nitrites, chlorates, hydrogen peroxide, and/or chelating agents can be added as accelerators. Adding accelerators will shorten the phosphatization time.

This invention is explained in further detail below by means of working examples.

Method of Measuring Film Quantity and Composition Prior to Addition of Lubricant After a phosphatized test plate was precisely weighed with an analytical balance, it was immersed in a 5% aqueous solution of chromic acid for 15 minutes at 75° C., so that the phosphate film was removed. The test plate was weighed after removal of the phosphate film, and the quantity of the phosphate film that had been produced was calculated from the difference between the two weights.

The composition of the film was measured by means of an X-ray diffraction device. The X-ray diffraction intensities of the zinc phosphate (020) surface, zinc ferrous phopate (200) surface, and zinc calcium phosphate (020) surface were measured using a copper tube X-ray source. The quantity of zinc calcium phosphate in the film was calculated according to the following formula from the X-ray diffraction intensity, and its value was defined to be the "S ratio":

$$S\ ratio = S/(H+P+S)$$

where H denotes the X-ray diffraction intensity of the zinc phosphate (020) surface; P denotes the X-ray diffraction intensity of the zinc ferrous phosphate (200) surface; and S denotes the X-ray diffraction intensity of the zinc calcium phosphate (020) surface.

Method of Calculating Lubricant Adhesion Quantity and Phosphate Film Quantity After Addition of Lubricant A. When Using a Reactive Soap Lubricant The quantity of lubricant film produced by a reactive soap lubricant was defined as follows:

Lubricant Quantity A: (W1-W2)/surface area

Film Quantity A: (W2-W3)/surface area

These film quantities were calculated from the measured values of W1, W2, and W3 obtained as described below.

W1: The weight in grams of a test substrate to which a lubricant film has been adhered was obtained, after the test substrate had been immersed in distilled water for 30 minutes at 90 to 95° C. and subsequently allowed to stand in the ambient natural atmosphere until it reached room temperature (i.e., 18–23° C.), by weighing precisely with an analytical balance.

W2: The test substrate that had been weighed as described in W1 was immersed for 30 minutes in a mutual solution of isopropyl alcohol, normal heptane, and ethylene glycol monoethyl ether in a mixture ratio of 6:3:1 respectively by weight heated to 70° C. in a container provided with a reflux condenser to maintain constant composition of the solution. After dissolution, the test substrate was cooled to room temperature and weighed precisely as described above.

W3: The test substrate from W2 was immersed in a 5% aqueous solution of chromic acid for 15 minutes at 70° C. and the phosphate film was dissolved; the test substrate was then washed in water. After drying and cooling by means of a PLAJET™ drier, the test substrate was weighed precisely.

B. When Using a Non-reactive Metallic Soap Water-dispersed Lubricant (hereinafter abbreviated as "non-reactive lubricant")

The quantity of lubricant film per unit area adhering to the test substrate was calculated from the difference in the weight of the test substrate before and after treatment with a non-reactive lubricant, and the result was defined as Lubricant Quantity B. In addition, prior to treatment with the lubricant, the test substrate was immersed in a 5% aqueous solution of chromic acid for 15 minutes at 70° C. and the phosphate film was dissolved; the test substrate was then thoroughly washed in water, dried by means of a PLAJET™ drier, and weighed precisely by means of an analytical balance. The quantity of phosphate film was calculated from the difference between the weights prior to and following the removal of the film, and was defined as Film Quantity B.

Method of Evaluating Lubricity

Sliding lubricity was evaluated by means of a Bauden-Leven friction testing device. The friction coefficient when a ball of high carbon chrome bearing steel SUJ-2 with a diameter of 5 millimeters (hereinafter usually abbreviated as "mm") was moved under a perpendicular load of 5 kilograms with a frequency of 1 Hz over a path with a length of 10 mm was measured, and the number of traverses of this path after which the friction coefficient reached 0.25 was determined. A higher number of traverses in this test indicates better sliding lubricity.

Test Substrates and Their Pretreatment

Cold rolled steel plates of Type SPCC-SD with dimensions of 0.8 mm×70 mm×150 mm were used. Pre-treatment of these test substrates consisted of alkaline degreasing by immersing the plates for 10 minutes in a 2% aqueous solution of Fine Cleaner® 4360 (commercially available from Nihon Parkerizing Co., Ltd.) that had been heated to 60° C., then washing them in tap water for 30 seconds by means of a spraying device.

WORKING EXAMPLE 1

A surface conditioning liquid composition was prepared at room temperature by crushing reagent grade zinc phosphate tetrahydrate ($Zn_3(PO_4)_2.4H_2O$) for 10 minutes in a ball mill using zirconium beads, adjusting the concentration of zinc phosphate in dispersion in water to 10 g/L, then adding 1 g/L of sodium pyrophosphate.

A calcium-type phosphatizing solution was prepared by adding 0.8 g/L of sodium nitrite as a catalyst to a phosphatizing solution comprising 4 g/L of zinc ions, 4 g/L of calcium ions, 12 g/L of phosphate ions, and 13 g/L of nitrate ions; this solution is briefly denoted hereinafter as "Phosphatizing Solution A".

A test substrate pretreated as described above was immersed for 1 minute in the surface conditioning liquid composition prepared in the manner described above, then immersed for 5 minutes in Phosphatizing Solution A as described above and heated to 80° C.

WORKING EXAMPLE 2

A given quantity of an aqueous solution containing 0.1 mole of zinc nitrate per liter of solution (the unit of mole(s) per liter of solution being hereinafter applied to other substances as well as to zinc nitrate and being abbreviated as "M") was added to the same quantity of a 0.3 M aqueous solution of calcium nitrate that had been heated to 50° C. and, while maintaining the temperature, a 0.3 M solution of sodium monohydrogen phosphate was added to produce a precipitate. The mixture including precipitate and supernatant liquid was heated at 90° C. for one hour to age the precipitate, which was then washed ten times on an inclined plane surface. A dried sample of the precipitate as prepared by heating the washed precipitate in an oven at 80° C., and the sample as then analyzed by X-ray diffraction; it was verified that the compound was zinc calcium phosphate.

A 0.3 M solution of sodium monohydrogen phosphate was added to a 0.3 M aqueous solution of calcium nitrate that had been heated to 50° C., while maintaining the temperature, to produce a precipitate. The mixture including precipitate and supernatant liquid was heated at 90° C. for one hour to age the precipitate, which was then washed ten times on an inclined plane surface. A dried sample was prepared by heating the washed precipitate in an oven at 80° C., and the sample was then analyzed by X-ray diffraction; it was verified that the compound was calcium monohydrogen phosphate.

Next, reagent grade zinc phosphate tetrahydrate and the zinc calcium phosphate and calcium monohydrogen phosphate obtained from the processes described in the two preceding paragraphs were mixed so that their weight ratio would be 3:4:3, respectively, and the resultant mixture was crushed for 10 minutes in a ball mill using zirconium beads. The concentration of the crushed phosphate mixture was adjusted to 10 g/L of total dispersed phosphates in water, then 1 g/L of sodium pyrophosphate was added at room temperature to prepare a surface conditioning liquid composition.

A test substrate pretreated as described above was immersed for 1 minute in the surface conditioning liquid composition prepared in the manner described above, then immersed for 5 minutes in a phosphatizing solution prepared as described in Working Example 1 and heated to 80° C.

WORKING EXAMPLE 3

The zinc calcium phosphate and calcium monohydrogen phosphate obtained as described in Working Example 2 were mixed so that their weight ratio would be 6:4, and the resultant mixture was crushed for 10 minutes in a ball mill using zirconium beads. The concentration of the crushed phosphate mixture was adjusted to 10 g/L of total dispersed phosphates in water, then 1 g/L of sodium pyrophosphate was added at room temperature to prepare a surface conditioning liquid composition.

A test substrate pretreated as described above was immersed for 1 minute in the surface conditioning liquid composition prepared in the manner described above, then immersed for 5 minutes in a phosphatizing solution prepared as described in Working Example 1 and heated to 80° C.

WORKING EXAMPLE 4

The calcium monohydrogen phosphate obtained as described in Working Example 2 was crushed for 10 minutes in a ball mill using zirconium beads. The concentration of the crushed phosphate mixture was adjusted to 10 g/L of total dispersed phosphates in water, then 1 g/L of sodium pyrophosphate was added at room temperature to prepare a surface conditioning liquid composition.

A test substrate pretreated as described above was immersed for 1 minute in the surface conditioning liquid composition prepared in the manner described above, then immersed for 5 minutes in a phosphatizing solution prepared as described in Working Example 1 and heated to 80° C.

WORKING EXAMPLE 5

0.1 percent of a commercially available colloidal titanium-type surface conditioner, PREPALENE®-Z manufactured by Nihon Parkerizing Co., Ltd., was prepared at room temperature. A test substrate pretreated as described above was immersed for 1 minute in the surface conditioning liquid composition prepared in the manner described above, then immersed for 5 minutes in a phosphatizing solution prepared as described in Working Example 1 and heated to 80° C.

WORKING EXAMPLE 6

A calcium-type phosphatizing agent was prepared by adding 0.8 g/L of sodium nitrite as a catalyst to a phosphatizing solution comprised of 6 g/L of zinc ions, 3 g/L of calcium ions, 12 g/L of phosphate ions, and 15 g/L of nitrate ions; this solution is briefly denoted hereinafter as "Phosphatizing Solution B".

A test substrate pretreated as described above was immersed for 1 minute in the surface conditioning liquid composition prepared in the manner described in Working Example 3, then immersed for 5 minutes in a phosphatizing solution prepared as described above and heated to 80° C.

WORKING EXAMPLE 7

A test substrate pretreated as described above was immersed for 1 minute in the surface conditioning liquid composition prepared in the manner described in Working Example 4, then immersed for 5 minutes in Phosphatizing Solution B heated to 80 0C.

COMPARISON EXAMPLE 1

Without using a surface conditioning liquid composition, a test substrate pretreated as described above was immersed for 10 minutes in a phosphatizing solution prepared by adding 2 "points" of accelerator to a 9% solution of a zinc phosphate-type phosphatizing concentrate, PALBOND® 421 WD, commercially available from Nihon Parkerizing Co., Ltd., this solution being briefly denoted hereinafter as "Phosphatizing Solution C", which had been heated to 80° C.

COMPARISON EXAMPLE 2

A test substrate was immersed in Phosphatizing Solution C under the same conditions described in Comparison Example 1 after treatment prior to phosphatization with a colloidal titanium-type surface conditioner as used in Working Example 5.

COMPARISON EXAMPLES 3, 4, and 5

Using a phosphafizing solution prepared by adding 2 points of accelerator to a 9% solution in water of a calcium phosphate-type phosphatizing concentrate, PALBOND® 3670X WD, commercially available from Nihon Parkerizing Co., Ltd., which had been heated to 80° C., as the basis, a number of phosphatizing solutions were prepared with varying weight ratios of calcium ions to zinc ions by means of additives. In Comparison Example 3, the weight ratio of calcium ions to zinc ions was adjusted to 0.3 to form "Phosphatizing Solution D"; in Comparison Example 4, the weight ratio of calcium ions to zinc ions was adjusted to 0.5 to form "Phosphatizing Solution E"; and in Comparison Example 5, the weight ratio of calcium ions to zinc ions was adjusted to 1.0 to form "Phosphatizing Solution F". Three test substrates that had been pretreated as described previously were immersed for 5 minutes in one of Phosphatizing Solutions D, E, and F, without using a surface conditioning liquid composition.

Lubrication

The test substrates that had been phosphatized as described in the various Working Examples and Comparison Examples were lubricated using reactive soap lubricants and non-reactive lubricants.

For lubrication using a reactive soap lubricant, a test substrate was immersed for 7 minutes in a 6% solution of PALUBE® 235 concentrate, commercially available from Nihon Parkerizing Co., Ltd., which had been heated to 80° C., then air-dried. For lubrication using a non-reactive lubricant, a test substrate was immersed for 1 minute in a 20% solution of PALUBE® 4612 concentrate, commercially available from Nihon Parkerizing Co., Ltd., at 25° C., then dried in a 70° C. oven for 30 minutes.

Tables 1 and 2 show the S Ratio, P Ratio, Lubricant Quantity, Film Quantity, and Number of Sliding Rotations for Working Examples 1 through 7 and Comparison Examples 1 through 5 with both reactive and non-reactive lubricants. Judging from the results of the Working Examples and Comparison Examples, the following statements can be made.

(1) According to the Working Examples, phosphate films with different compositions and different S Ratios and P Ratios can be obtained even when the same type of phosphatizing solution (fixed Ca/Zn ratio) is used.

(2) In the Working Examples, it was made clear that phosphate films with a high S Ratio are useful as a base for non-reactive lubricants, whereas phosphate films with a high P Ratio are useful as a base for reactive soap lubricants. It is evident that it is extremely easy to obtain the target type of film depending on the lubricant to be applied according to the phosphatizing method that constitutes this invention.

(3) When attempting to obtain phosphate films with different S Ratios and P ratios and different compositions as in this invention, when not pre-treating a surface with a surface conditioning liquid composition, as indicated in the cases of Comparison Examples 1, 3, 4, and 5, the Ca/Zn ratio of the phosphatizing solution must be modified accordingly.

LARGE SCALE WORKING EXAMPLES

The practical properties of this invention were verified using the surface conditioners indicated in Working Examples 1, 2, 3, and 4 with the PALBOND® 3682X line of calcium-type phosphatizing concentrates manufactured by Nihon Parkerizing Co., Ltd. The temperature of the surface conditioner was room temperature; the concentration of the

TABLE 1

SURFACE CONDITIONING AND PHOSPHATIZING DATA

| | Surface Conditioner | | Phosphatizing Solution | | Coating Composition Ratios | |
|---|---|---|---|---|---|---|
| Identifier | Active Ingredient(s) | Concentration (g/L) | Type | $Ca^{2+}/Zn^{2+}$ Ratio | S Ratio | P Ratio |
| Working Example 1 | $Zn_3(PO_4)_2.4H_2O$ | 10 | A | 1.0 | 0.01 | 0.75 |
| Working Example 2 | $Zn_3(PO_4)_2.4H_2O$<br>$Zn_2Ca(PO_4)_2.2H_2O$<br>$CaHPO_4.2H_2O$ | 3<br>4<br>3 | | 1.0 | 0.16 | 0.48 |
| Working Example 3 | $Zn_2Ca(PO_4)_2.2H_2O$<br>$CaHPO_4.2H_2O$ | 6<br>4 | | 1.0 | 0.41 | 0.39 |
| Working Example 4 | $CaHPO_4.2H_2O$ | 10 | | 1.0 | 0.83 | 0.17 |
| Working Example 5 | Colloidal Titanium | 3 | | 1.0 | 0.03 | 0.71 |
| Working Example 6 | $Zn_2Ca(PO_4)_2.2H_2O$<br>$CaHPO_4.2H_2O$ | 6<br>4 | B | 0.5 | 0.34 | 0.42 |
| Working Example 7 | $CaHPO_4.2H_2O$ | 10 | | 0.5 | 0.75 | 0.22 |
| Comparison Example 1 | None | — | C | 0 | 0.00 | 0.74 |
| Comparison Example 2 | Colloidal Titanium | 3 | C | 0 | 0.00 | 0.67 |
| Comparison Example 3 | None | — | D | 0.3 | 0.23 | 0.48 |
| Comparison Example 4 | None | — | E | 0.5 | 0.48 | 0.31 |
| Comparison Example 5 | None | — | F | 1.0 | 0.82 | 0.18 |

phosphatizing agent was according to standard specifications, and the solution temperature was controlled at 80 to 90° C.

The substrates phosphatized were cold-rolled steel wire (Types SWRCH8R, SWRCH45K, and SCM435), and a high carbon, chrome bearing steel wire (SUJ-2). For the cold rolled steel wire, the surface conditioners used in Working Examples 1, 2, and 3 were first applied; for the high carbon, chrome bearing steel wire, the surface conditioner used in Working Example 4 was first applied.

With respect to implementation, a 10-ton surface conditioner vat was installed in front of the 20-ton phosphatizing vat; as the contents of the surface conditioner vat were changed for Working Examples 1, 2, 3, and 4, the composition of the

TABLE 2

LUBRICANT AND LUBRICATED SUBSTRATE DATA

| | Data for Reactive Lubricants | | | Data for Non-Reactive Lubricants | | |
|---|---|---|---|---|---|---|
| Identifier | Lubricant Quantity A ($g/m^2$) | Film Quantity A ($g/m^2$) | Number of Sliding Paths A | Lubricant Quantity B ($g/m^2$) | Film Quantity B ($g/m^2$) | Number of Sliding Paths B |
| Working Example 1 | 6.3 | 4.4 | 720 | 6.5 | 5.4 | 380 |
| Working Example 2 | 5.6 | 5.7 | 646 | 6.7 | 6.4 | 473 |
| Working Example 3 | 3.4 | 5.5 | 532 | 7.2 | 5.9 | 651 |
| Working Example 4 | 0.9 | 4.6 | 330 | 7.4 | 4.7 | 924 |
| Working Example 5 | 0.8 | 3.9 | 682 | 6.7 | 4.8 | 345 |
| Working Example 6 | 1.4 | 5.5 | 576 | 6.9 | 6.0 | 650 |
| Working Example 7 | 1.0 | 5.0 | 430 | 7.2 | 5.2 | 730 |
| Comparison Example 1 | 6.0 | 7.2 | 684 | 6.8 | 8.3 | 352 |
| Comparison Example 2 | 5.8 | 3.4 | 632 | 6.4 | 5.4 | 360 |
| Comparison | 4.5 | 6.9 | 550 | 7.2 | 7.5 | 560 |

TABLE 2-continued

| LUBRICANT AND LUBRICATED SUBSTRATE DATA | | | | | | |
|---|---|---|---|---|---|---|
| | Data for Reactive Lubricants | | | Data for Non-Reactive Lubricants | | |
| Identifier | Lubricant Quantity A ($g/m^2$) | Film Quantity A ($g/m^2$) | Number of Sliding Paths A | Lubricant Quantity B ($g/m^2$) | Film Quantity B ($g/m^2$) | Number of Sliding Paths B |
| Example 3 | | | | | | |
| Comparison | 2.4 | 6.1 | 403 | 7.4 | 6.4 | 715 |
| Example 4 | | | | | | |
| Comparison | 0.7 | 5.6 | 320 | 6.9 | 5.8 | 820 |
| Example 5 | | | | | | |

As a result, compared to the conventional setup in which 3 phosphatizing vats were installed, each containing a different phosphatizing solution prepared to have a different composition and maintained and controlled individually, the quality of the phosphate film produced became more stable and problems associated with poor lubricity and die clogging were resolved. Furthermore, because only one phosphatizing vat was required, the heat energy cost was reduced to one-third of the cost associated with the conventional method.

Benefits of the Invention

As described above, the method of phosphatizing iron and steel that is this invention stabilizes the quality of the phosphate film produced and resolves the problems associated with poor lubricity and die clogging. Furthermore, the control of the phosphatizing solution is facilitated, and heat energy costs can be reduced. Therefore, the industrial utility of this invention is extremely significant.

What is claimed is:

1. A method of forming a phosphate conversion coating on a substrate surface of iron or steel, said process comprising operations of:

(I) contacting the substrate surface on which a phosphate conversion coating to be formed with a surface conditioning liquid composition that comprises, as dispersed particles, at least one of zinc phosphate, zinc calcium phosphate, calcium phosphate and colloidally dispersed titanium, so as to form a conditioned substrate surface, the surface conditioning liquid composition further comprising from 0.001 to 5.0 g/L of total oxides selected from the group of oxides of silicon, boron, titanium, zirconium, aluminum, lead, magnesium, cerium, zinc, tin, iron, molybdenum, and vanadium; and (II) contacting the conditioned substrate surface provided at the end of operation (I) with a phosphatizing solution that comprises calcium catons.

2. The method of claim 1 wherein the concentration of total dispersed phosphate salt is from 0.01 to 50 g/L.

3. The method of claim 1 wherein said concentration is from 0.1 to 10 g/L.

4. The method of claim 1 wherein the surface conditioning liquid additionally comprises at least one dispersion stabilizing material selected from the group of dissolved alkali metal and ammonium salts of orthophosphoric acid, dissolved alkali metal and ammonium salts of metaphosphoric acid, dissolved alkali metal and ammonium salts of pyrophosphoric acid, dissolved alkali metal and ammonium salts of orthosilicic acid, dissolved alkali metal and ammonium salts of metasilicic acid, dissolved alkali metal and ammonium salts of carbonic acid, dissolved alkali metal and ammonium salts of boric acid, dissolved anionic polymers, dissolved nonionic polymers, dissolved anionic surfactants, dissolved nonionic surfactants, dispersed anionic surfactants, and dispersed nonionic surfactants.

5. A method of forming a phosphate conversion coating on a substrate surface of iron or steel, the method comprising:

(I) contacting the substrate surface on which a phosphate conversion coating to be formed with a surface conditioning liquid composition that comprises, as dispersed particles, at least one of zinc phosphate, zinc calcium phosphate, and calcium phosphate, so as to form a conditioned substrate surface, the surface conditioning liquid composition additionally comprising at least one dispersion stabilizing material selected from the group of dissolved alkali metal and ammonium salts of orthophosphoric acid, dissolved alkali metal and ammonium salts of metaphosphoric acid, dissolved alkali metal and ammonium salts of pyrophosphoric acid, dissolved alkali metal and ammonium salts of orthosilicic acid, dissolved alkali metal and ammonium salts of metasilicic acid, dissolved alkali metal and ammonium salts of carbonic acid, dissolved alkali metal and ammonium salts of boric acid, dissolved anionic polymers, dissolved nonionic polymers, dissolved anionic surfactants dissolved nonionic surfactants, dispersed anionic surfactants, and disposed nonionic surfactants; and (II) contacting the conditioned substrate surface provided at the end of operation (I) with a phosphatizing solution that comprises calcium cations.

6. The method of claim 5 wherein the concentration of total dispersed phosphate salt is from 0.01–50 g/L.

7. The method of claim 5 wherein the concentration is from 0.1 to 10 g/L.

8. The method of claim 5 wherein the surface conditioning liquid composition additionally comprises from 0.001 to 5.0 g/L of total oxides selected from the group of the oxides of silicon, boron, titanium, zirconium, aluminum, lead, magnesium, cerium, zinc, tin, iron, molybdenum, and vanadium.

* * * * *